US010254059B1

(12) United States Patent
Fellows et al.

(10) Patent No.: US 10,254,059 B1
(45) Date of Patent: Apr. 9, 2019

(54) PISTOL WITH FRAME INSERT

(71) Applicant: Franklin Armory Holdings, Inc., Minden, NV (US)

(72) Inventors: Ryan Paul Fellows, San Jose, CA (US); Jay Leonard Jacobson, Minden, NV (US)

(73) Assignee: FRANKLIN ARMORY HOLDINGS, INC., Minden, NV (US)

( * ) Notice: Subject to any disclaimer, the term of this patent is extended or adjusted under 35 U.S.C. 154(b) by 0 days.

(21) Appl. No.: 15/723,064

(22) Filed: Oct. 2, 2017

(51) Int. Cl.
*F41A 3/66* (2006.01)
*F41C 23/10* (2006.01)
*F41A 11/02* (2006.01)

(52) U.S. Cl.
CPC ..... *F41A 3/66* (2013.01); *F41A 11/02* (2013.01); *F41C 23/10* (2013.01)

(58) Field of Classification Search
CPC ..... F41A 3/66; F41C 23/10; F41C 23/16
See application file for complete search history.

(56) References Cited

U.S. PATENT DOCUMENTS 5,293,708 A 3/1994 Strayer et al.
5,669,169 A * 9/1997 Schmitter ..... F41A 3/66 42/71.02
6,260,301 B1 7/2001 Aigner et al.
6,993,864 B1 * 2/2006 O'Clair ..... F41A 3/14 42/71.02
2013/0036644 A1 * 2/2013 Bardy ..... F41A 3/64 42/69.03
2017/0321980 A1 * 11/2017 Wolf ..... F41A 19/15

OTHER PUBLICATIONS

Fabbrica D'Armi Pietro Beretta S.P.A., "Pico," http://www.beretta.com/en/pico/, Accessed Jul. 10, 2017.
Sig Sauer, "P320," https://www.sigsauer.com/products/firearms/pistols/p320/, (c) 2017, Accessed Jul. 10, 2017.
Sig Sauer, "P250," https://www.sigsauer.com/products/firearms/pistols/p320/, (c) 2017, Accessed Jul. 10, 2017.

* cited by examiner

*Primary Examiner* — Stephen Johnson
(74) *Attorney, Agent, or Firm* — Bennet K. Langlotz; Langlotz Patent & Trademark Works, LLC

(57) ABSTRACT

Pistols with frame inserts have a frame having a grip, the frame having spaced apart upper sidewall portions having upper edges defining a slide interface plane, the upper sidewall portions being planar elements each having inner faces facing each other and exterior faces facing away from each other, each upper sidewall portion defining a side opening adjacent to the slide interface plane and having a perimeter spaced apart from the slide interface plane, a frame insert including pistol action components connected to the frame, and the frame insert having opposed insert sidewalls, each frame insert sidewall having a selected portion registered with and occupying a respective one of the side openings of the frame. The frame may define a cavity width between selected portions of the inner faces adjacent to the frame side openings, and wherein the frame insert has a width at the selected portion greater than the cavity width.

29 Claims, 5 Drawing Sheets

PISTOL WITH FRAME INSERT

FIELD OF THE INVENTION

The present invention relates to firearms, and more particularly to a pistol with frame insert.

BACKGROUND OF THE INVENTION

In 1994, Sandy L. Strayer and Virgil P. Trip were granted a patent for a "frame/handgun assembly for autoloading handgun" (U.S. Pat. No. 5,293,708). This design was novel and effective for its time because it allowed the effective use of a steel frame and a polymer subframe. However, this design was limited in that it was only designed to work with the manufacturer-supplied subframe. The consumer could not modify the subframe to fit their hand better. The consumer could not specify the color of the subframe material. The consumer could not specify the engraved embellishments of the exterior. The consumer could not specify the texture, pattern, and angle or size of the grip, or the size and shape of the trigger guard. In addition, the Strayer/Trip design did not allow for modification of the subframe with the intent of making the subframe, frame, and slide usable and adaptable to a variety of preexisting magazine designs made by other manufacturers.

The frame for the P250 pistol manufactured by Sig Sauer, Inc. of Exeter, N.H. is an ingenious design that allows the user to register the serialized trigger mechanism and modify the components around the mechanism. As such, a user can convert their existing pistol into a different size and caliber P250 by simply purchasing the Sig Sauer, Inc. components that surround the registered part. However, this design was limited in that it was only designed to work with the manufacturer-supplied subframes. The consumer could not easily modify the subframe to fit their hand better. The consumer could not specify the color of the subframe material. The consumer could not specify the engraved embellishments of the exterior. The consumer could not specify the texture, pattern, and angle, or size of the grip or the size and shape of the trigger guard. In addition, this design does not allow the consumer to modify the firearm to accept magazines from a different model or manufacturer.

The P250's subframe technology has the additional disadvantage of being limited to wide-frame pistols. This limitation arises from the inability to fit the trigger mechanism into the subframe without widening the overall frame of the pistol. The entire subframe must fit within the width of the P250 pistol less the pistol frame wall thickness.

Furthermore, both designs above do not provide for the manufacture of a solid frame, or subframe, with a filled magazine well. This oversight would likely preclude their manufacturers from providing the buyers in states with restrictive manufacturing or import laws, such as California, with a single shot pistol.

Therefore, a need exists for a new and improved pistol with frame insert that can be sold with a filled magazine well. In this regard, the various embodiments of the present invention substantially fulfill at least some of these needs. In this respect, the pistol with frame insert according to the present invention substantially departs from the conventional concepts and designs of the prior art, and in doing so provides an apparatus primarily developed for the purpose of providing a pistol with frame insert that can be sold with a filled magazine well.

SUMMARY OF THE INVENTION

The present invention provides an improved pistol with frame insert, and overcomes the above-mentioned disadvantages and drawbacks of the prior art. As such, the general purpose of the present invention, which will be described subsequently in greater detail, is to provide an improved pistol with frame insert that has all the advantages of the prior art mentioned above.

To attain this, the preferred embodiment of the present invention essentially comprises a frame having a grip, the frame having spaced apart upper sidewall portions having upper edges defining a slide interface plane, the upper sidewall portions being planar elements each having inner faces facing each other and exterior faces facing away from each other, each upper sidewall portion defining a side opening adjacent to the slide interface plane and having a perimeter spaced apart from the slide interface plane, a frame insert including pistol action components connected to the frame, and the frame insert having opposed insert sidewalls, each frame insert sidewall having a selected portion registered with and occupying a respective one of the side openings of the frame. The frame may define a cavity width between selected portions of the inner faces adjacent to the frame side openings, and wherein the frame insert has a width at the selected portion greater than the cavity width. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
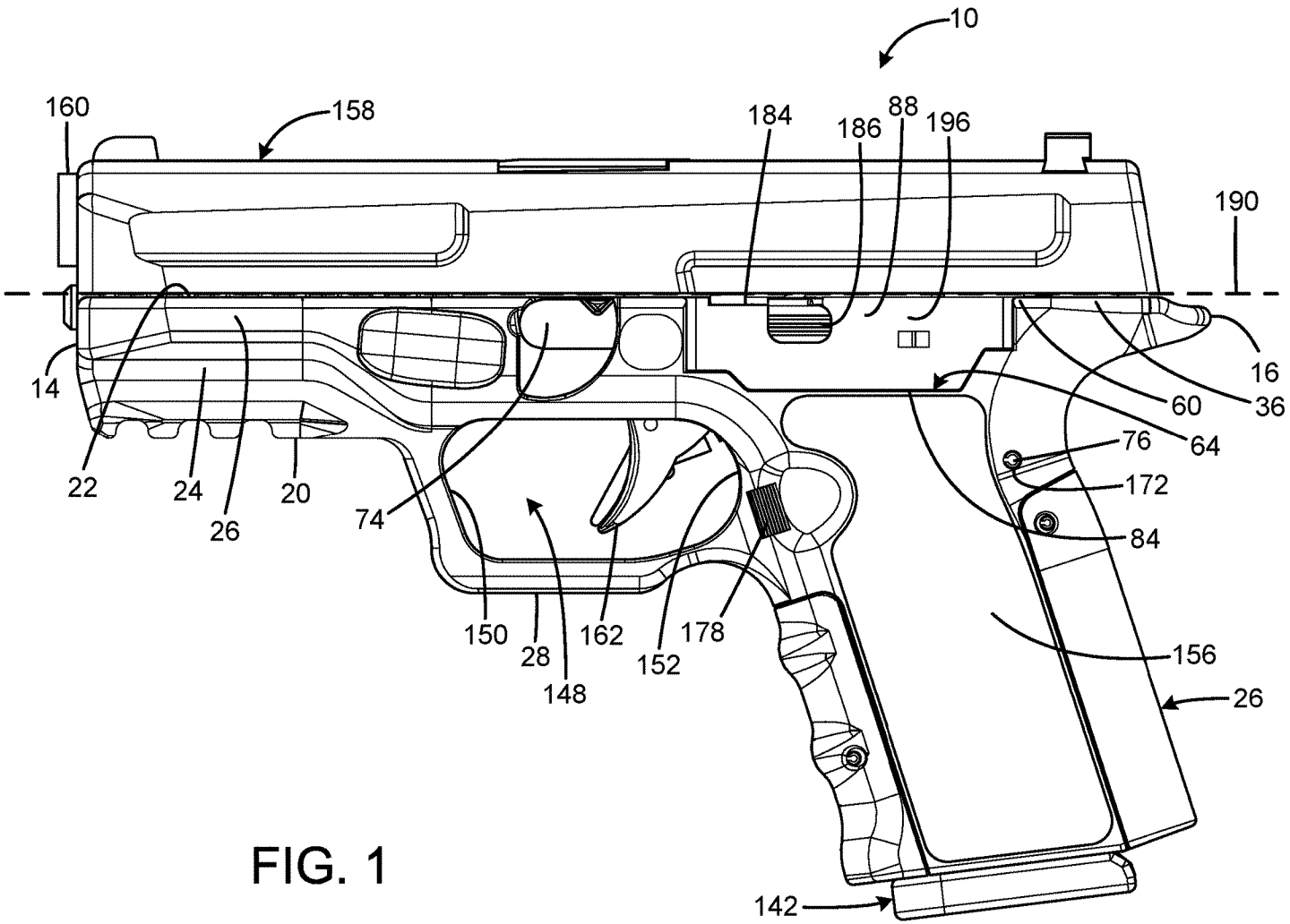
FIG. 1 is a left side view of the current embodiment of the pistol with frame insert constructed in accordance with the principles of the present invention.

An embodiment of the pistol with frame insert of the present invention is shown and generally designated by the reference numeral 10.

Figure 2:
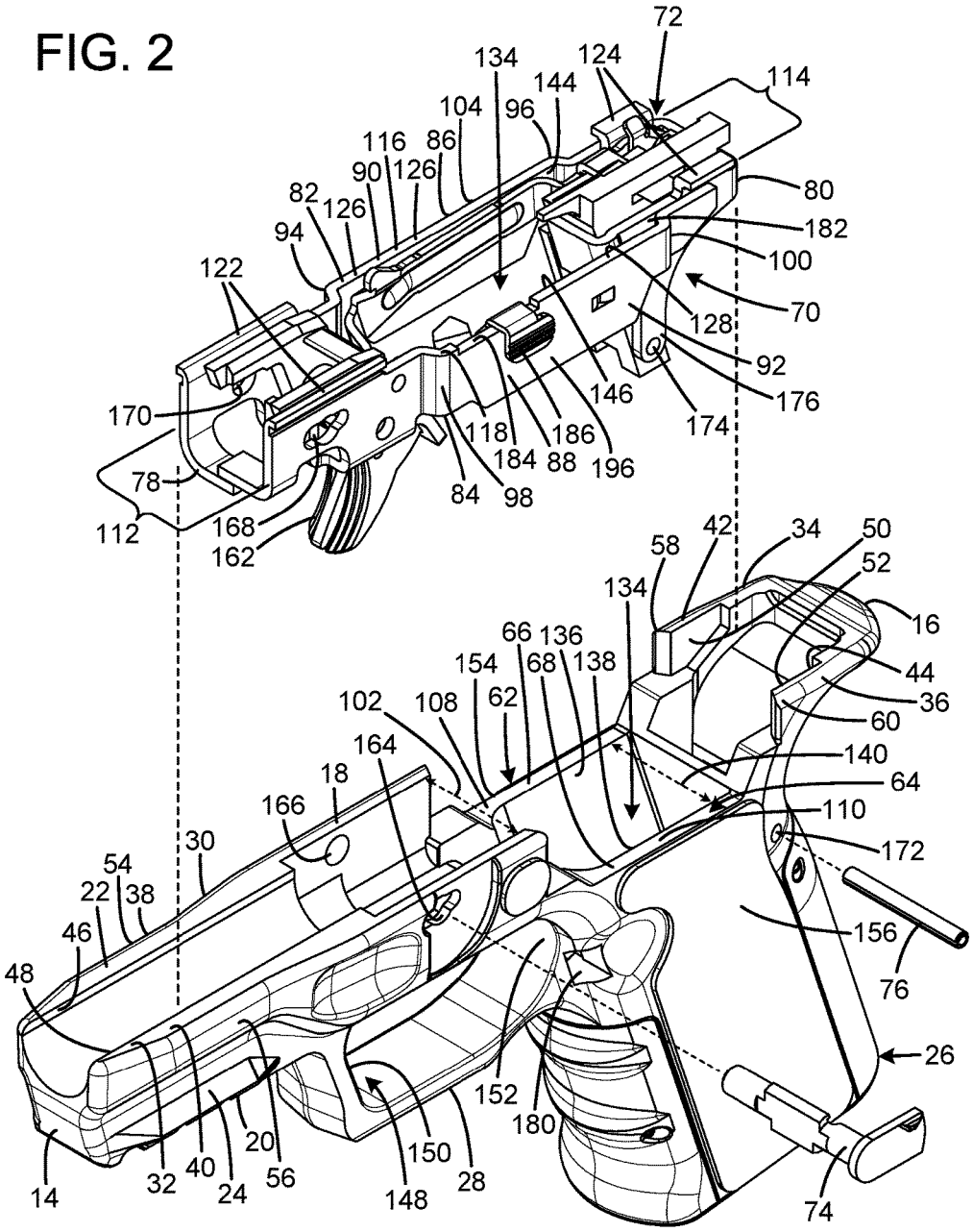
FIG. 2 is an exploded view of the frame insert and grip of FIG. 1.
Figure 3:
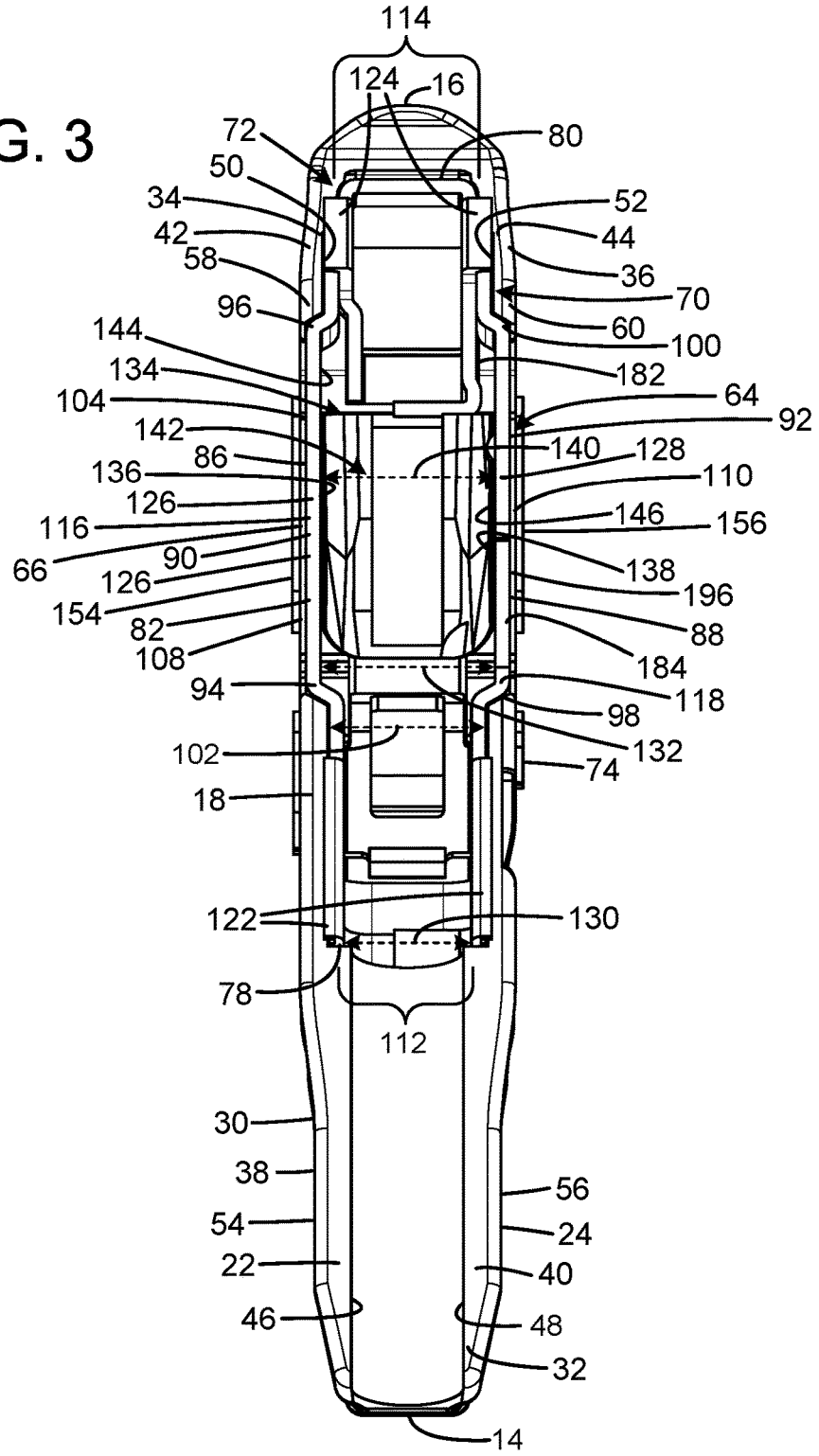
FIG. 3 is a top view of the pistol with frame insert of FIG. 1 with the slide removed.
Figure 4:
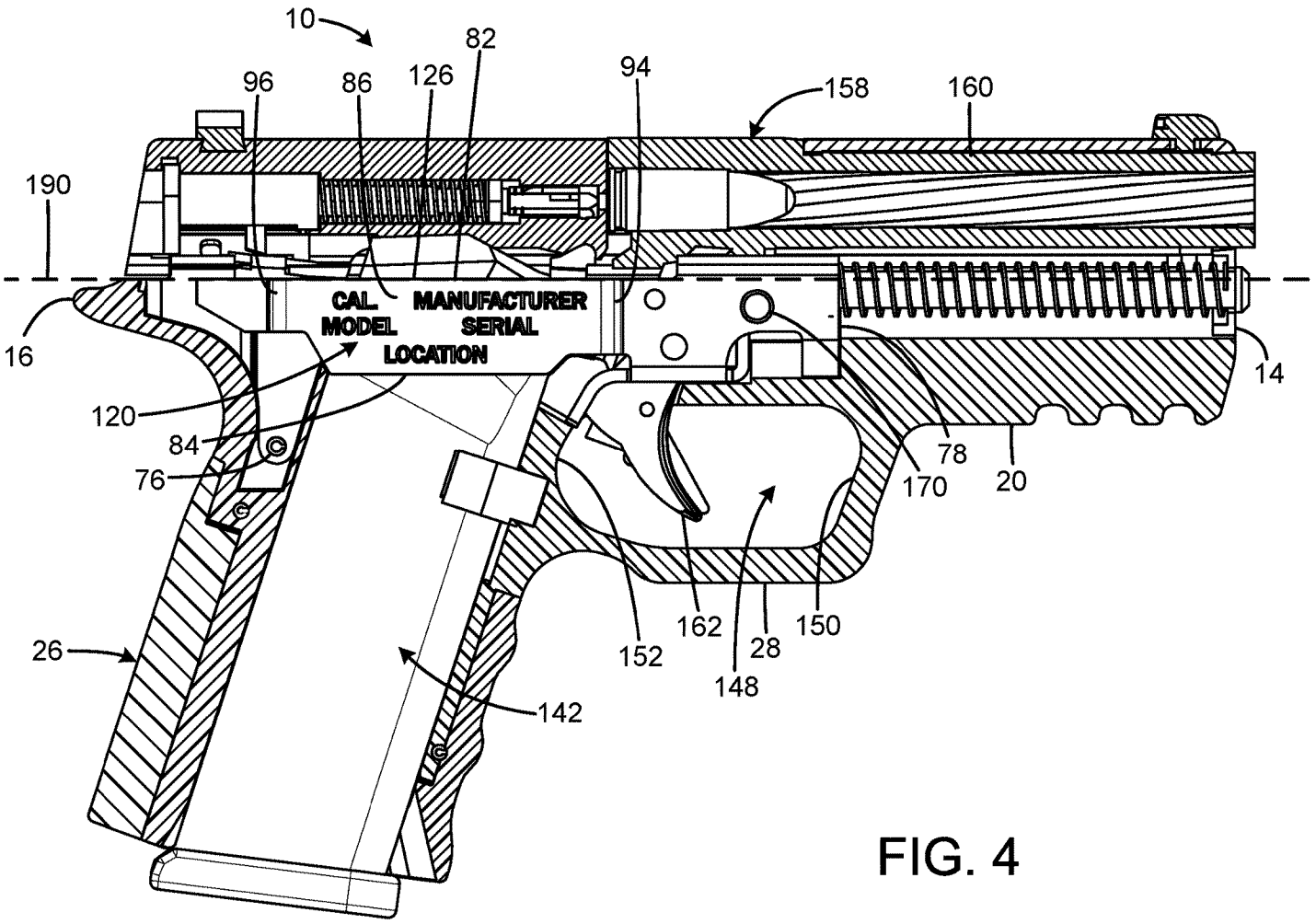
FIG. 4 is a right side sectional view of the pistol with frame insert of FIG. 1.
Figure 5:
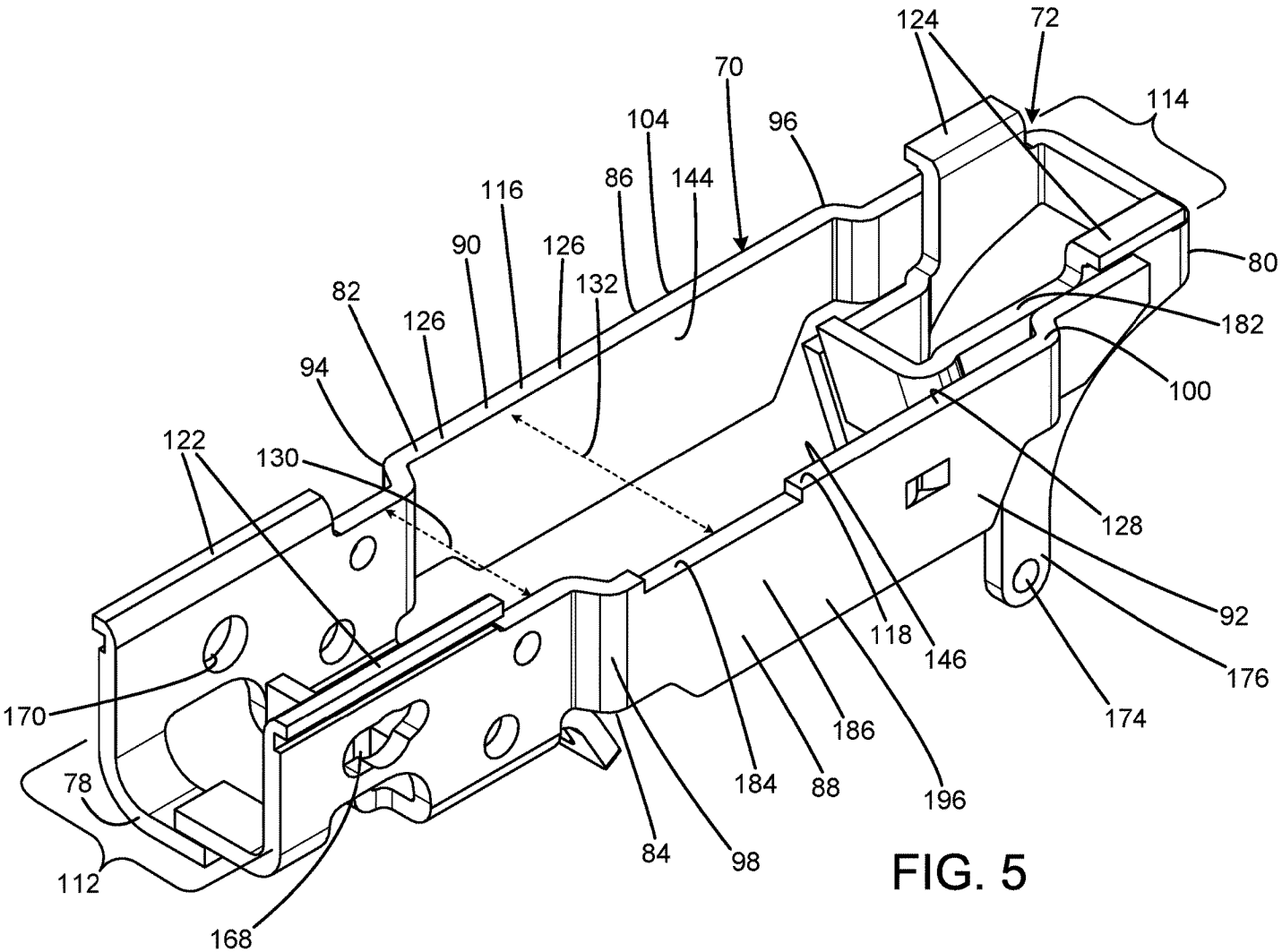
FIG. 5 is a top isometric view of the frame insert of FIG. 1 removed from the pistol.

FIGS. 1-5 illustrate the improved pistol with frame insert 10 of the present invention. More particularly, the pistol of frame insert has a frame 12 having a front 14, rear 16, top 18, bottom 20, right 22, and left 24. The frame includes a grip 26 and a trigger guard 28. The frame has spaced apart right and left front upper sidewall portions 30, 32 and right and left rear upper sidewall portions 34, 36. Each of the upper sidewall portions has an upper edge 38, 40, 42, 44 that define a slide interface plane 190. The upper sidewall portions are planar elements each having inner faces 46, 48, 50, 52 facing each other and exterior faces 54, 56, 58, 60 facing away from each other. Each upper sidewall portion defines a side opening 62, 64 adjacent to the slide interface plane and having a perimeter 66, 68 spaced apart from the slide interface plane.

A frame insert 70 including pistol action components 72 is connected to the frame 12 by a front pin 74 and a rear pin 76. The frame insert has a front 78, rear 80, top 82, bottom 84, right 86, and left 88. The frame insert has opposed frame insert sidewalls 90, 92. Each frame insert sidewall has a selected portion 126, 128 registered with and occupying a respective one of the side openings 62, 64 of the frame. The selected portion 126 of the right frame insert sidewall is located between S bends 94, 96. The selected portion 128 of the left frame insert sidewall is located between S bends 98, 100.

The frame 12 defines a cavity width 102 between selected portions of the inner faces 46, 48, 50, 52 adjacent to the frame side openings 62, 64. The frame insert 70 has a width between the selected portions of the frame insert sidewalls greater than the cavity width. The selected portions 126, 128 of the frame insert sidewalls have exterior surfaces 104, 106 forming an exterior surface of the pistol 10 adjacent to the exterior faces 54, 56, 58, 60 of the frame upper sidewall portions 30, 32, 34, 36. Each frame side opening has a lower edge 108, 110 spaced apart from and parallel to the slide interface plane 190.

The frame insert 70 includes a front narrowed portion 112 and a rear narrowed portion 114 adjacent to the selected portions 126, 128 of the frame insert sidewalls 90, 92 and closely received between the front frame upper sidewall portions 30, 32 and the rear frame upper sidewall portions 34, 36. The narrowed portions have a lesser width than the frame 12 at the selected portions of the inner faces 46, 48, 50, 52 adjacent to the frame side openings 62, 64. The frame insert includes upper edges 116, 118 that also define the slide interface plane 190. The frame insert includes indicia 120 visible in at least one of the side openings 62, 64 of the frame. In the current embodiment, the indicia are located on the right exterior surface 104 of the selected portion 126 of the right insert sidewall 90. The indicia can include markings that denote a caliber, manufacture, model, serial number, and/or location.

The frame insert 70 includes a plurality of front frame rails 122 and rear frame rails 124 extending above the slide interface plane 190. The front frame rails are located forward of the selected portions 126, 128, and the rear frame rails are located rearward of the selected portions. The frame insert includes opposed parallel enclosed sidewall portions adjacent to the selected portions 126, 128 and to the slide interface plane that are the same as the previously identified front narrowed portion 112 and rear narrowed portion 114. The enclosed sidewall portions define a gap therebetween having a limited first width 130. The space between the selected portions has a greater second width 132. The selected portions are parallel to the enclosed sidewall portions. The front enclosed sidewall portions are forward of the selected portions, and the rear enclosed sidewall portions are rearward of the selected portions.

The grip 26 of the frame 12 defines a magazine well passage 134 having opposed sidewalls 136, 138. The opposed sidewalls are spaced apart by a magazine well width 140 adapted to slidably receive a magazine 142 having a magazine width. The selected portions 126, 128 of the frame insert 70 have interior surfaces 144, 146 spaced apart by an amount adapted to receive a magazine having the magazine width that is equal to or slightly wider than the magazine well width 140. The interior surfaces 144, 146 have a slightly wider spacing so the frame can support magazines of different widths (e.g. single stack or double stack magazines) within the same frame, by substituting a different grip with a magazine well passage width compatible with the selected magazine width. For example, in the current embodiment, the interior surfaces 144, 146 of the frame insert are spaced apart 0.005 inch more than the opposed sidewalls 136, 138 of the grip. However, in an alternative embodiment of the grip that accommodates a single stack 1911 magazine, the interior surfaces 144, 146 of the frame insert are spaced apart 0.381 inch more than the opposed sidewalls 136, 138 of the grip. It is also believed the interior surfaces 144, 146 of the frame insert would be spaced apart even more than 0.381 inch compared to the opposed sidewalls 136, 138 of the grip for a grip that accommodates a .22 magazine. The opposed sidewalls of the magazine well passage are adjacent to the selected portions of the frame insert. The magazine can be removed from the magazine well passage when a magazine release 178 that protrudes through a magazine release aperture 180 in the grip is depressed.

The frame 12 has a trigger guard 28 defining a trigger opening 148. The trigger opening has a curved upper transition surfaces 150, 152 having upper limits immediately below parallel frame side wall surface portions 54, 56. Each of the frame side openings 62, 64 has a lower limit (lower edges 108, 110) at a level below the upper limits of the curved upper transition surfaces.

The selected portions 126, 128 of the frame insert 70 have exterior surfaces 104, 106 that are flush with the exterior faces 154, 156 of the frame 12 adjacent to the respective side openings 62, 64. The top 82 of the left selected portion defines a slide lock notch 184 that receives a slide lock 186.

The frame 12 can also be considered a housing. A barrel slide 158 is movably mounted on the housing for movement in a firing direction with respect to a barrel 160. A trigger mechanism, including a trigger 162 and the pistol action component 72, is located at least in part within the housing. The frame insert 70 is a multifunction metal part removably insertable within the housing. The frame insert is releasably secured to the housing by the front pin 74 and the rear pin 76. The front pin is removably inserted through apertures 164 and 166 in the housing and apertures 168 and 170 in the frame insert. The rear pin is removably inserted through two apertures in the rear 16 of the housing (aperture 172 is visible) and two apertures in the rear 80 of the frame insert (aperture 174 in the downwardly protruding left rear lug 176 is visible). The frame insert is provided with guides for the barrel slide (front frame rails 122 and rear frame rails 124) and a trigger mechanism support facility 182. The selected sidewall portions 126, 128 occupy the sidewall openings 62, 64 such that the indicia 120 are exposed. Because the indicia are exposed for regulatory compliance, the pistol 10 can have a polymer outer grip while still displaying the firearm markings without utilizing complex or expensive overmolding technology to mold a steel insert with the required markings into a polymer frame.

In the current embodiment, the frame 12 is made of a polymer and has a cavity width 102 of 0.857 inch, a magazine well width of 0.927 inch that receives a magazine 142 having a top magazine width of 0.9 inch, a width measured from the exteriors of the lower edges 108, 110 of 1.15 inch, and a wall thickness of 0.147 inch. In the current embodiment, the frame insert 70 is made of steel and has a limited first width 130 of 0.681 inch, a greater second width 132 of 0.932 inch, a width measured from the exterior surfaces 104, 106 of the selected portions 126, 128 of the frame insert sidewalls 90, 92 of 1.089 inch, and a wall thickness of 0.078 inch. Enabling the selected portions 126, 128 of the frame insert 70 to have exterior surfaces 104, 106 that are flush with the exterior faces 154, 156 of the frame 12 adjacent to the respective side openings 62, 64 eliminates the 0.147 inch thick frame wall on both sides, thereby reducing the width of the pistol 10 by over 0.25 inch at that location. This arrangement also minimizes the overall pistol width to the magazine width plus a gap tolerance plus the thickness of the frame material to provide an overall width of 1.089 inch at that location.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a pistol with frame insert has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, the frame insert of the current invention is also suitable for use with a rifle in addition to the pistol described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A pistol comprising:

a frame having a grip;

the frame having spaced apart upper sidewall portions having upper edges defining a slide interface plane;

the upper sidewall portions being planar elements each having inner faces facing each other and exterior faces facing away from each other;

each said upper sidewall portion defining a side opening adjacent to the slide interface plane and having a perimeter spaced apart from the slide interface plane;

a frame insert including pistol action components connected to the frame;

the frame insert having opposed insert sidewalls, each frame insert sidewall having a first portion forward of the side opening and between the inner faces of the upper sidewall portions, a second portion registered with and occupying a respective one of the side openings of the frame, and a third portion aft of the side opening and between the inner faces of the upper sidewall portions; and wherein the frame insert includes indicia visible in the side opening of the frame.

2. The pistol of claim 1 wherein the frame defines a cavity width between the second portions of the inner faces adjacent to the frame side openings, and wherein the frame insert has a width at the second portions greater than the cavity width.

3. The pistol of claim 1 wherein the second portions of the frame insert have exterior surfaces forming an exterior surface of the pistol adjacent to the exterior faces of the frame upper sidewall portions.

4. The pistol of claim 1 wherein each said side opening has a lower edge spaced apart from and parallel to the slide interface plane.

5. The pistol of claim 2 wherein the frame insert includes a narrowed portion adjacent to the second portions and closely received between the frame upper sidewall portions.

6. The pistol of claim 5 wherein the narrowed portion has a lesser width than the frame at the second portions of the inner faces adjacent to the frame side openings.

7. The pistol of claim 5 including said narrowed portion forward of and aft of the side openings.

8. The pistol of claim 1 wherein the frame insert includes an upper edge in the slide interface plane.

9. The pistol of claim 1 wherein the frame insert includes a plurality of frame rails extending above the slide interface plane.

10. The pistol of claim 9 wherein some of the rails are forward of the second portion and some of the rails are aft of the second portion.

11. The pistol of claim 1 wherein the frame insert includes opposed parallel enclosed sidewall portions adjacent to the second portions and to the slide interface plane, the enclosed sidewall portions defining a gap therebetween having a limited first width, the space between the second portions being a greater second width.

12. The pistol of claim 11 wherein the second portions are parallel to the enclosed sidewall portions.

13. The pistol of claim 11 including said enclosed sidewall portions forward and aft of the second portions.

14. The pistol of claim 1 wherein the grip of the frame defines a magazine well passage having opposed sidewalls spaced apart by a magazine well width adapted to slidably receive a magazine having a magazine width, and wherein the second portions of the frame insert have interior surfaces spaced apart by an amount adapted to receive said magazine having the magazine width that is greater than or equal to the magazine well width.

15. The pistol of claim 14 wherein the interior surfaces are spaced apart by an amount that is greater than or equal to 0.005 inch and less than or equal to 0.381 inch wider than the magazine well width.

16. The pistol of claim 14 wherein the magazine well passage opposed sidewalls are adjacent to the second portions of the frame insert.

17. The pistol of claim 14 wherein the frame has a trigger guard defining a trigger opening, the trigger opening having curved upper transition surfaces having upper limits immediately below said exterior faces of the frame upper sidewall portions, each said side opening having a lower limit at a level below the upper limits of the curved upper transition surfaces.

18. The pistol of claim 1 wherein the frame insert sidewall selected portion has an exterior surface flush with exterior faces of the frame adjacent to the respective side opening.

19. The pistol of claim 1 wherein the first and third positions each include slide rails.

20. A pistol comprising a housing, a barrel slide movably mounted on the housing for movement in a firing direction with respect to a barrel, and a trigger mechanism located, at least in part, within the housing, the improvement which comprises:

a multifunction metal part removably insertable within said housing;

said multifunction metal part being provided with guides for the barrel slide and a trigger mechanism support facility;

the housing defining a sidewall opening;

the multifunction metal part including a sidewall portion occupying the sidewall opening;

wherein the sidewall portion of the multifunction metal part includes indicia visible in the sidewall opening of the housing; and the guides being forward and aft of the sidewall opening.

21. A pistol comprising:

a frame having a grip;

the frame having spaced apart upper sidewall portions having upper edges defining a slide interface plane;

the upper sidewall portions being planar elements each having inner faces facing each other and exterior faces facing away from each other;

each said upper sidewall portion defining a side opening adjacent to the slide interface plane and having a perimeter spaced apart from the slide interface plane;

a frame insert including pistol action components connected to the frame;

the frame insert having opposed insert sidewalls, each said frame insert sidewall having a selected portion registered with and occupying a respective one of the side openings of the frame;

wherein the selected portion of one of the frame insert sidewalls includes indicia visible in one of the side openings of the frame; and the frame insert having a slide rail spaced apart from the selected portion in a linear direction selected from the linear directions including forward and aft.

22. The pistol of claim 21 wherein the slide rail is forward of the selected portion.

23. The pistol of claim 22 wherein the slide rail is aft of the selected portion.

24. A pistol comprising:

a frame having a grip defining a magazine well;

the frame having spaced apart upper sidewall portions having upper edges defining a slide interface plane;

the upper sidewall portions being planar elements each having inner faces facing each other and exterior faces facing away from each other;

each upper sidewall portion defining a side opening adjacent to the slide interface plane and having a perimeter spaced apart from the slide interface plane;

a frame insert including pistol action components connected to the frame;

the frame insert having opposed insert sidewalls, each said frame insert sidewall having a selected portion registered with and occupying a respective one of the side openings of the frame;

wherein the selected portion of one of the frame insert sidewalls includes indicia visible in one of the side openings of the frame; and the selected portions of the frame insert sidewall being above the magazine well and adapted to closely receive a magazine therebetween.

25. The pistol of claim 24 wherein the frame insert includes a slide rail aft of the selected portion.

26. The pistol of claim 24 wherein the frame insert includes a slide rail forward of the selected portion.

27. The pistol of claim 24 wherein the selected portions of the insert sidewalls are free of structural elements spanning between the selected portions, such that a magazine is unobstructed.

28. The pistol of claim 24 wherein each said selected portion of the frame insert sidewalls is free of penetrations.

29. The pistol of claim 24 wherein the selected portion of the insert sidewalls have flat inside surfaces parallel to and facing each other.

* * * * *